US010300617B2

(12) United States Patent
Savolainen

(10) Patent No.: US 10,300,617 B2
(45) Date of Patent: May 28, 2019

(54) CUTTING TOOL AND MANUFACTURING METHOD

(71) Applicant: Fiskars Finland Oy Ab, Helsinki (FI)

(72) Inventor: Heikki Savolainen, Helsinki (FI)

(73) Assignee: Fiskars Finland Oy Ab, Helsinki (FI)

( * ) Notice: Subject to any disclaimer, the term of this patent is extended or adjusted under 35 U.S.C. 154(b) by 90 days.

(21) Appl. No.: 15/503,987

(22) PCT Filed: Aug. 26, 2015

(86) PCT No.: PCT/FI2015/050547
§ 371 (c)(1),
(2) Date: Feb. 14, 2017

(87) PCT Pub. No.: WO2016/034764
PCT Pub. Date: Mar. 10, 2016

(65) Prior Publication Data

US 2017/0252932 A1 Sep. 7, 2017

(30) Foreign Application Priority Data

Sep. 1, 2014 (FI) ..... 20145757

(51) Int. Cl.
*B26B 13/04* (2006.01)
*B26B 13/28* (2006.01)

(52) U.S. Cl.
CPC ..... *B26B 13/285* (2013.01); *B26B 13/04* (2013.01); *B26B 13/28* (2013.01)

(58) Field of Classification Search
CPC ..... B26B 13/285; B26B 13/04; B26B 13/28
See application file for complete search history.

(56) References Cited

U.S. PATENT DOCUMENTS 1,846,867 A * 2/1932 Hershey ..... B26B 13/00 30/256
2,083,483 A * 6/1937 Strezoff ..... B26B 13/28 30/195

(Continued)

FOREIGN PATENT DOCUMENTS

CN 201394847 Y 2/2010
CN 201427315 Y 3/2010

(Continued)

OTHER PUBLICATIONS

English-language translation of Chinese Office Action, App. No. 201580046351.9, Fiskars Finland Oy Ab, 9 pages (dated Jan. 10, 2018).

(Continued)

*Primary Examiner* — Andrea L Wellington
*Assistant Examiner* — Fernando A Ayala
(74) *Attorney, Agent, or Firm* — Foley & Lardner LLP

(57) ABSTRACT

A cutting tool includes first and second blades attached to each other by a joint, and first and second handles. A first inlay having a protruding end protrudes into a hole in the first blade. A shaft has a first end joined to the protruding end of the first inlay, and has a second end with at least one transverse shoulder. A second inlay has a protruding end protruding into a hole in the second blade and a hole receives the second end of the shaft, and an engaging surface engages with the shoulder of the shaft. The hole of the second inlay has a shape and width allowing the second end of the shaft with the shoulder to pass into the hole in a release position, but prevents the shaft and shoulder from passing through the hole when the shaft and second inlay are not in the release position.

8 Claims, 3 Drawing Sheets

(56) References Cited

U.S. PATENT DOCUMENTS

| | | | | |
|---|---|---|---|---|
| 5,687,823 | A * | 11/1997 | Nakagawa | F16D 9/02 192/84.961 |
| 5,862,552 | A * | 1/1999 | Koelewyn | A01K 97/00 7/132 |
| 6,484,791 | B1 * | 11/2002 | Vidal | A61C 13/20 164/113 |
| 2005/0120566 | A1 | 6/2005 | Dworschak et al. | |
| 2006/0010692 | A1 * | 1/2006 | Kuan Huo | B26B 11/005 30/122 |
| 2007/0101582 | A1 | 5/2007 | Escobar et al. | |
| 2007/0169356 | A1 | 7/2007 | Gianola | |
| 2010/0198244 | A1 * | 8/2010 | Spivey | A61B 17/320016 606/174 |
| 2012/0047751 | A1 * | 3/2012 | Nene | B26B 13/12 30/254 |
| 2012/0052146 | A1 * | 3/2012 | Hollriegl | B29C 49/42 425/523 |
| 2017/0245849 | A1 * | 8/2017 | Swift | A61B 17/02 |

FOREIGN PATENT DOCUMENTS

| | | | |
|---|---|---|---|
| JP | H563467 | U | 8/1993 |
| WO | WO-03/094756 | A1 | 11/2003 |

OTHER PUBLICATIONS

Canada Office Action Received for Canadian Application No. 2957815, dated Jul. 23, 2018, 3 pages.
Finland Office Action, App. No. 20145757, Fiskars Home Oy Ab, 3 pages (dated Apr. 17, 2015).
International Search Report and Written Opinion, PCT/FI2015/050547, Fiskars Home Oy Ab, 10 pages (dated Nov. 23, 2015).

* cited by examiner

CUTTING TOOL AND MANUFACTURING METHOD

CROSS-REFRENCE TO RELATED APPLICATIONS

This application is a U.S. National Stage of PCT/FI2015/050547, filed Aug. 26, 2015, which claims the benefit of and priority to Finland Patent Application No. 20145757, filed Sep. 1, 2014, the entire contents of each of which are incorporated herein by reference.

BACKGROUND OF THE INVENTION

Field of the Invention

This invention relates to a cutting tool and more particularly to a joint for a cutting tool. In the following the invention will be explained by way of example by referring to a pair of scissors. It should, however, be observed that the invention may be implemented also in connection with other cutting tools.

Description of Prior Art

Previously there is known a pair of scissors with a joint where the first blade is provided with a T shaped shaft protruding from the first blade and where the second blade is provided with a hole having a shape allowing the T shaped shaft to be threaded through the hole while the first and second blade are rotated to a predetermined mutual position. Once the T shaped shaft is threaded through the hole, the first and second blade are rotated out of the predetermined mutual position, such that the transverse part of the T shaped shaft comes into contact with the outer surface of the second blade and thereby locks the blades to each other.

A problem with the previously known solution is that it is difficult and expensive to provide the shaft made of metal and the hole with optimal shapes. Instead the shaft and hole is provided with sharp corners which makes it relatively difficult the thread the T shaped shaft through the hole.

Additionally, during use of the scissors the sharp edges of the shaft and hole cause scratches to appear in the vicinity of the joint, which eventually wears out the material such that the joint may not remain sufficiently tight for the entire lifetime of the pair of scissors. This may lower the performance of the pair of scissors, as a loose joint allows a gap to occur between the blades while cutting.

SUMMARY OF THE INVENTION

An object of the present invention is to solve the above mentioned drawback with a novel cutting tool and manufacturing method as defined in independent claims 1 and 8.

The use of a first and second inlay arranged in holes provided in the first and second blade of the cutting tool makes it easier to shape the surfaces of the joint in an optimal way to facilitate easy assembly and disassembly of the cutting tool. Additionally, the inlays and the shaft may easily be manufactured of a material other than the blades if it is determined that the material of the blades is not optimal for these parts.

Preferred embodiments of the invention are disclosed in the dependent claims.

BRIEF DESCRIPTION OF DRAWINGS

In the following the present invention will be described in closer detail by way of example and with reference to the attached drawings, in which.

DESCRIPTION OF AT LEAST ONE EMBODIMENT

Figure 1:
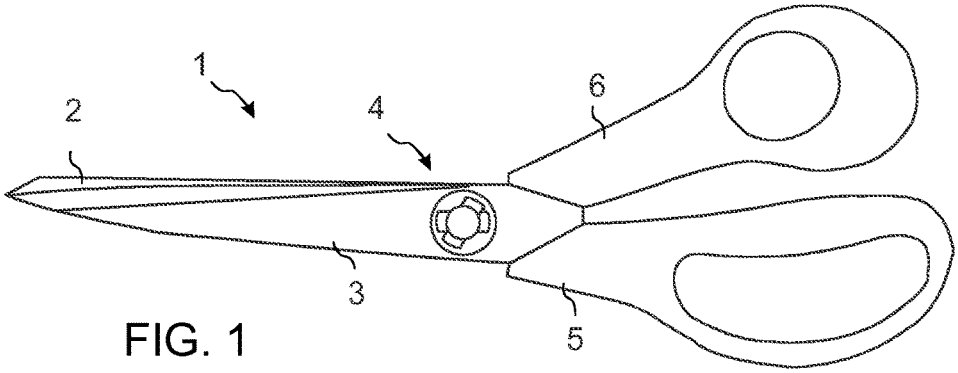
FIGS. 1 and 2 illustrate a first embodiment of a cutting tool.
Figure 2:
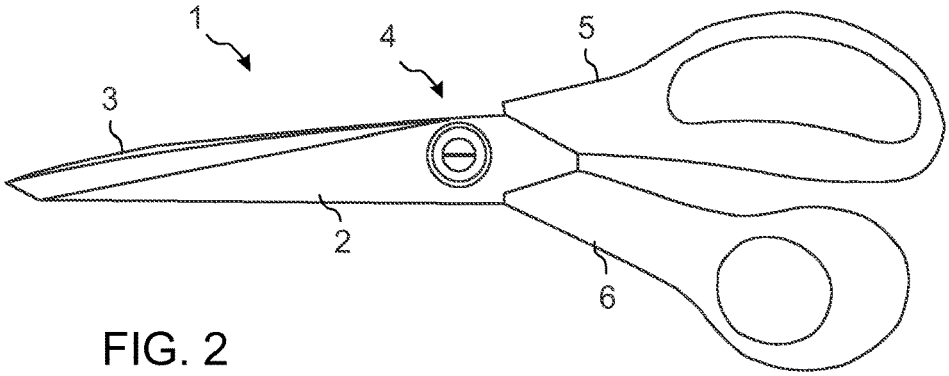

FIGS. 1 and 2 illustrate a first embodiment of a cutting tool 1. In the illustrated example the cutting tool 1 consists of a pair of scissors, with a first blade 2 and a second blade 3 attached to each other by a joint 4. A first handle 5 and a second handle 6 are operatively connected to the first 2 and second 3 blade for moving the first 2 and second 3 blade in relation to each other around a rotation axis 7 of the joint 4.

Figure 3:
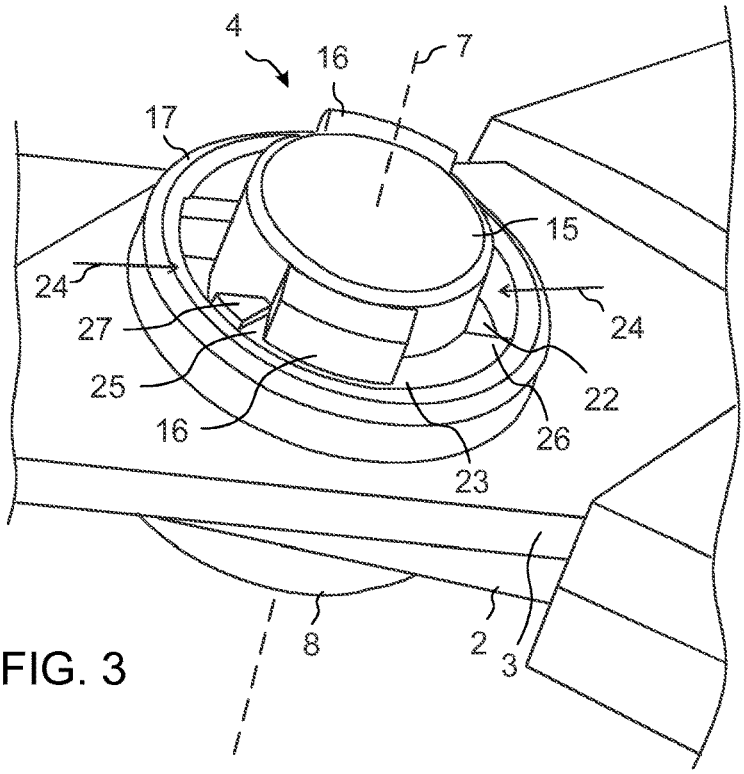
FIG. 3 is an enlargement of the joint in the cutting tool of FIGS. 1 and 2, and FIGS. 4 and 5 illustrate details of the joint of FIG. 3.
Figure 4:
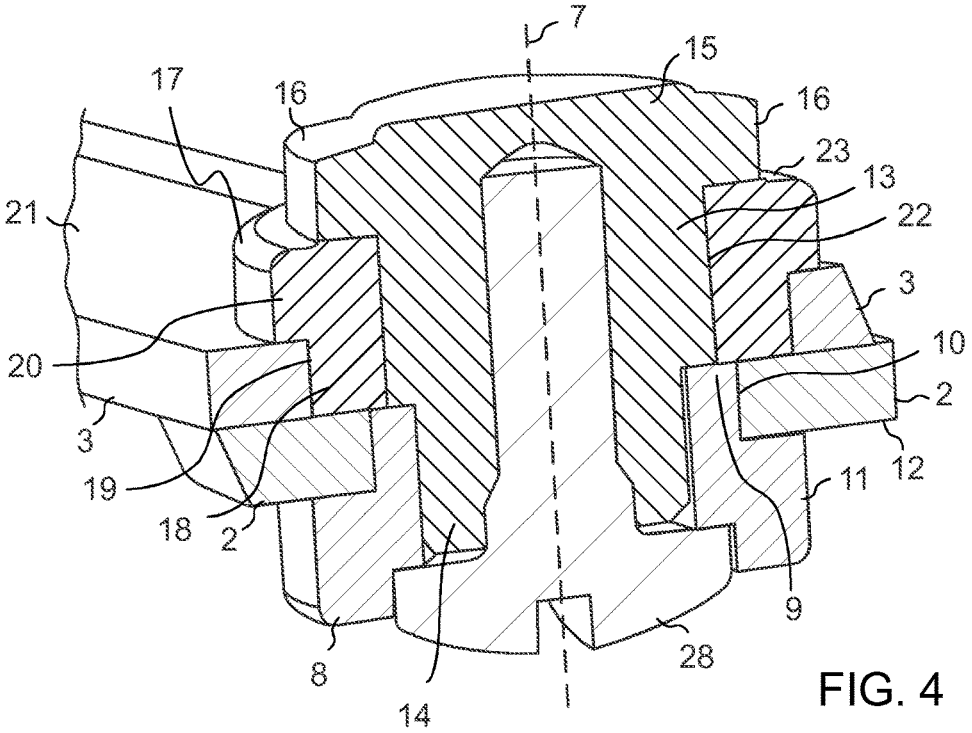
Figure 5:
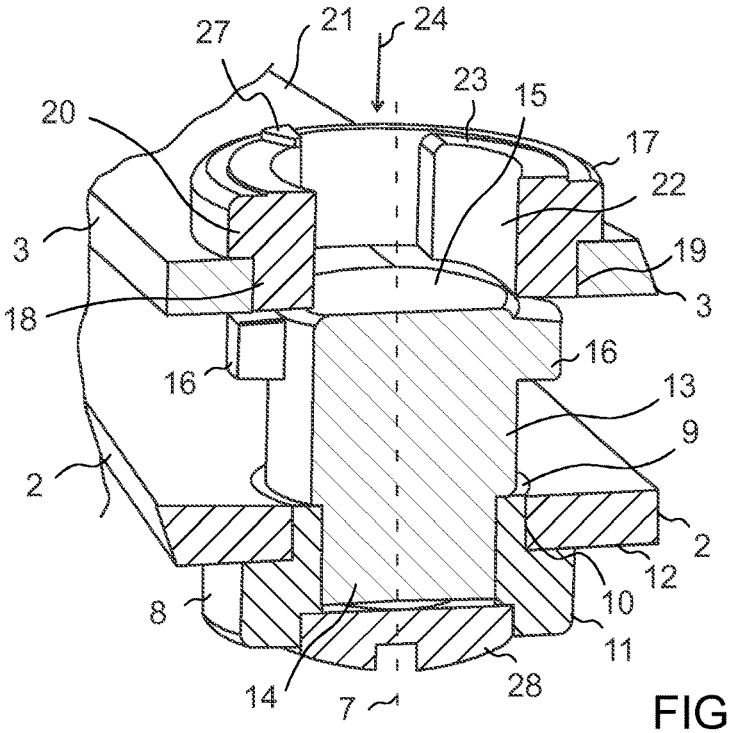
Figure 6:
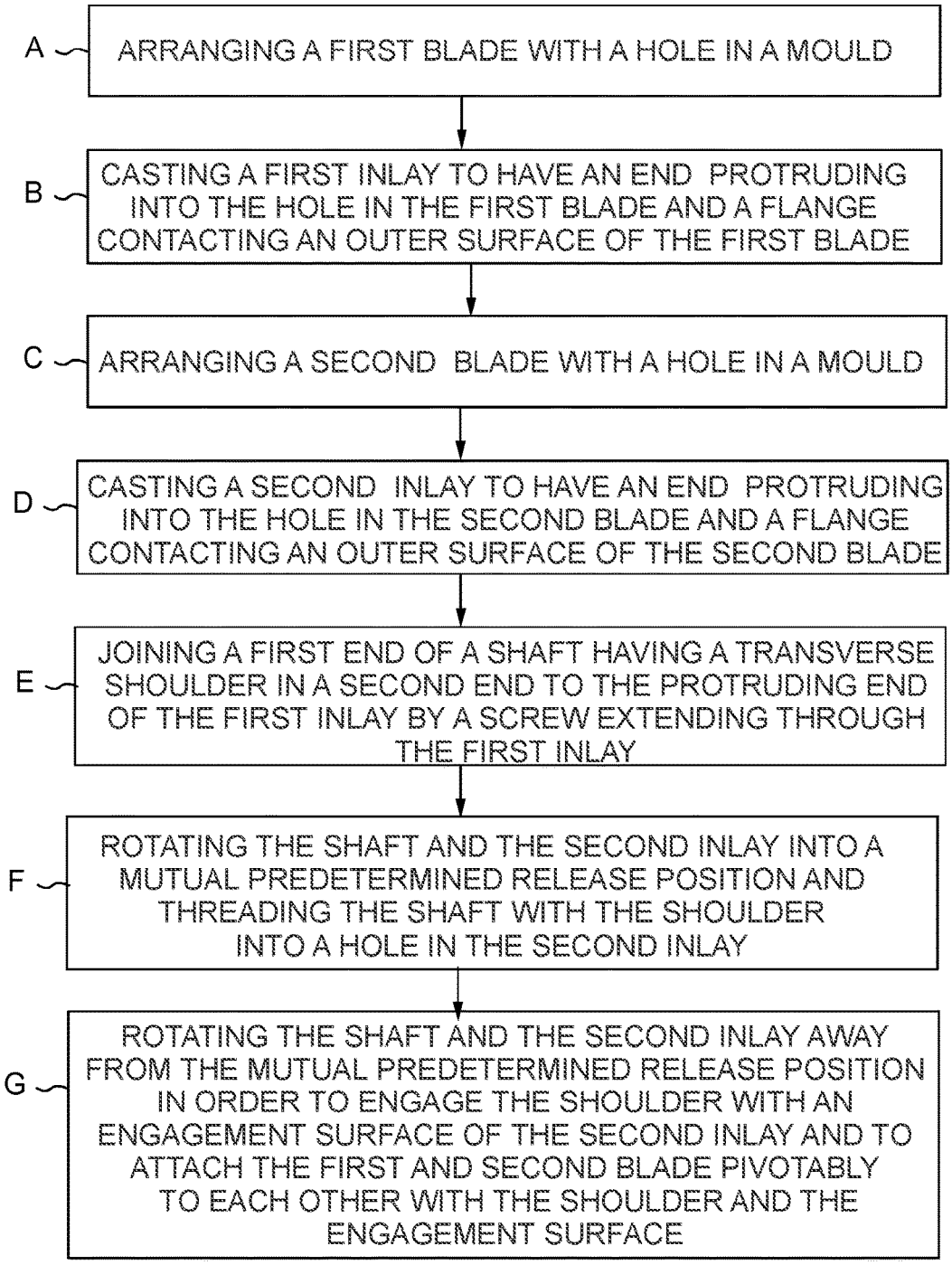
FIG. 6 is a flowchart of a method of manufacturing a joint for a cutting tool, according to an exemplary embodiment.

FIGS. 4 and 5 illustrate details of the joint 4 of FIG. 3. The joint 4 comprises a first inlay 8 with a protruding end 9 protruding into a hole 10 in the first blade 2. Additionally, the first inlay comprises a flange 11 contacting an outer surface 12 of the first blade 2.

A shaft 13 has a first end 14 joined to the protruding end 9 of the first inlay 8 and a second end 15 protruding from the protruding end 9 of the first inlay 8. Thus the shaft 13 is arranged as an extension of the protruding end 9 of the first inlay 8. The shaft 13 is provided with at least one transverse shoulder 16 in the second end 15. In the drawings it is, however, by way of example assumed that the second end of the shaft 13 is provided with two transverse shoulders 16, such that the second end 15 of the shaft 13 is generally T shaped.

A second inlay 17 has a protruding end 18 protruding into a hole 19 in the second blade 3. A flange 20 of the second inlay 17 contacts an outer surface 21 of the second blade 3. The second inlay 17 has a hole 22 receiving the second end 15 of the shaft 13. The second inlay 17 is provided with an engagement surface 23 for engaging with the shoulders 16 of the shaft 13 for attaching the second end 15 of the shaft 13 to the second inlay 17. In the example of FIGS. 3 to 5, the engagement surface 23 is the outer surface of the second inlay 17 which faces away from the first blade 2. In the illustrated example, the hole 22 extends through the entire second inlay 17, such that the second end 15 of the shaft protrudes through the entire second inlay 17. This is however, not necessary in all embodiments, as in some embodiments the hole of the second inlay need not protrude entirely through the second inlay, but instead the hole may be implemented as a cavity receiving the second end of the shaft.

As best seen in FIGS. 3 and 5, the hole 22 of the second inlay 17 has a shape and width allowing the second end 15 of the shaft 13 with the shoulders 16 to pass into the hole 22 while the shaft and second inlay are rotated into a mutual predetermined release position. In praxis the illustrated shoulders 16 are at that stage rotated into a position illustrated by arrows 24, where the diameter of the hole 22 is large enough to allow the shoulders 16 to pass through the hole 22. However, the shape and width of the hole 22 prevents the shaft 13 and shoulders 16 from passing through the hole 22 when the shaft 13 and second inlay 17 are not rotated into the mutual predetermined release position. For practical reasons the release position is set in such a way that when the shaft 13 and second inlay 17 reach the release position, the blades are in an open position, in other words the first 2 and second 3 blades have been mutually rotated around the rotation axis 7 as much away from each other as possible.

The shaft 13 is attached to the first blade 2 via the first inlay 8 to rotate together with the first blade 2 around the rotation axis 7. To facilitate this the first inlay 8 needs to be fixed to the first blade 2 such that it always rotates with the first blade 2. One alternative to accomplish this is that the hole 10 in the first blade 2 is not round, but oval or has a corner, for instance, while the first inlay 8 has a matching shape locking it into the hole 10. Similarly the second inlay 17 is attached to the second blade 3 to rotate with the second blade 3 around the rotation axis 7. Also this may be accomplished by selecting a suitable shape for the hole 19 in the second blade 3 and a matching shape for the second inlay 17. Alternatively, it is possible that the holes 10 and 19 are circular, in which case the inlays may be non-rotatably attached to the first and second blade in some other way, such as by use of an adhesive, for instance.

In the illustrated example the engagement surface 23 is inclined in relation to the first inlay 8 such that the shoulders 16 contact parts 25 of the engagement surface 23 which is are located further away from the first inlay 8, when the first 2 and second 3 blades are close to teach other (the position illustrated in FIGS. 1 to 3), than parts 26 of the engagement surface 23 which the shoulders 16 contact when the first 2 and second blade 3 are located at a distance from each other (not illustrated in the Figures). An advantage obtained with such an inclined engagement surface 23 is that the joint is relatively loose in the beginning of a cutting action (when the blades are mutually rotated away from each other). However, as the blades move closer to each other, the shoulders 16 move closer to the parts 25 of the engagement surface which is located furthest away from the first inlay 8. Due to this the tension in the joint becomes higher at the end of the cutting action, such that the blades 2 and 3 are pressed with a maximum force towards each other at the end of the cutting movement. This prevents the occurrence of a gap between the blades 2 and 3 at the end of the cutting movement, which is important for the cutting tool 1, such as a pair of scissors, in order for the cutting tool to work as efficiently as possible.

From FIG. 3 it can be seen that the engagement surface 23 is provided with a preventer 27 in the form of a protrusion protruding outwards from the engagement surface 23. This preventer comes into contact with one of the shoulders 16 once the shaft is rotated counterclockwise in FIG. 3 into the release position. This improves the user friendliness, as it is very easy for the user to know when the release position has been reached, as further mutual rotation is not possible due to the preventer.

In the illustrated example it is by way of example assumed that the shaft 13 is joined to the first inlay 8 with a screw 28, such as a steel screw, extending through the first inlay 8. Such a screw makes it possible for the user to adjust the tension of the joint 4. Additionally, the screw 28 may extend substantially through the entire shaft 13 in which case the screw 28 strengthens the shaft 13. In praxis the upper end of the screw 28 in FIG. 4 may be visible through the upper surface of the shaft 13, or alternatively not visible as in FIG. 4, but with the end of the screw in close vicinity to the upper surface of the shaft. In both cases the screw 28 extends substantially through the entire shaft 13.

It should, however, be observed that the use of a screw is not necessary in all embodiments. One possible alternative is to manufacture the shaft 13 and first inlay 8 to consist of one single part only. In that case the material of the combined shaft and first inlay joins the first end 14 of the shaft to the protruding end 9 of the first inlay 8.

One or more of the first inlay 8, the second inlay 17 and the shaft 13 may be manufactured of plastic. One alternative is to utilize glass fiber reinforced polyamide. In that case the joint 4 for the cutting tool may be manufactured as follows:

The first blade 2 of steel, for instance, is provided with a hole at the location of the pivot 4, and arranged in a mould. The first inlay 8 is casted in the mould with an injection-molding process, for instance. The second blade 3, of steel, for instance, is provided with a hole at the location of the pivot 4, and arranged in a mould. The second inlay 17 is casted in the mould with an injection-molding process for instance.

The shaft 13 may also be cast with an injection-molding process, after which the first end 14 of the shaft 13 may be attached to the first inlay 8 with a screw 28.

The shaft 13 and the second inlay 17 are rotated into a mutual predetermined release position, where the shaft with the shoulder 16 is threaded through the hole 22 in the second inlay 17. Finally, the shaft 13 and the second inlay 17 are rotated away from the mutual predetermined release position such that the shoulder 16 engages with the engagement surface 23 of the second inlay 17 and locks the first 2 and second 3 blade to each other via the shoulder 16 and the engagement surface 23.

An advantage obtained by manufacturing the parts of the joint in a mould by injection-molding, for instance, is that it is easier to manufacture the parts exactly according to desired tolerances, and the edges of the parts may easily and without additional work phases or costs be rounded which makes it easier to assemble joint. The parts may thereby be manufactured in such shapes and dimensions and of such materials that the material wear during use of the cutting tool may be minimized.

It is to be understood that the above description and the accompanying figures are only intended to illustrate the present invention. It will be obvious to a person skilled in the art that the invention can be varied and modified without departing from the scope of the invention.

The invention claimed is:

1. A cutting tool, comprising:

a first and second blade which are pivotably attached to each other by a joint, and a first and second handle which are operatively connected to the first and second blade for moving the first and second blade in relation to each other around a rotation axis of the joint, wherein the joint comprises:

a first inlay having a protruding end protruding into a hole in the first blade and a flange contacting an outer surface of the first blade, a shaft with a first end joined to the protruding end of the first inlay and with a second end protruding from the protruding end of the first inlay, the shaft having at least one transverse shoulder in the second end, and a second inlay having a protruding end protruding into a hole in the second blade and a flange contacting an outer surface of the second blade, the second inlay having a hole receiving the second end of the shaft, and an engaging surface for engaging with the shoulder of the shaft for attaching the second end of the shaft to the second inlay, and wherein the combination of the shape and width of the hole of the second inlay and the shape and width of the shoulder allow the second end of the shaft with the shoulder to pass into the hole while the shaft and second inlay are rotated into a mutual predetermined release position, but which prevents the shaft and shoulder from passing through the hole when the shaft and second inlay are not rotated into the mutual predetermined release position.

2. The cutting tool according to claim 1, wherein the shaft is attached to the first blade via the first inlay to rotate with the first blade around the rotation axis, the second inlay is attached to the second blade to rotate with the second blade around the rotation axis, the engagement surface of the second inlay is inclined in relation to the first inlay such that the shoulder contacts a part of the engagement surface which is located further away from the first inlay when the first and second blades are close to each other than a part of the engagement surface which the shoulder contacts when the first and second blade are located at a distance from each other.

3. The cutting tool according to claim 1, wherein the engagement surface is provided with a preventer contacting the shoulder to prevent the blades from being further rotated away from each other around the rotation axis once the shaft and second inlay have reached the mutual predetermined release position.

4. The cutting tool according to claim 1, wherein the first end of the shaft is joined to the protruding end of the first inlay with a screw extending through the first inlay.

5. The cutting tool according to claim 4, wherein the screw extends through the shaft from the first end of the shaft to the second end of the shaft.

6. The cutting tool according to claim 1, wherein one or more of the first inlay, second inlay and shaft are made of plastic.

7. The cutting tool according to claim 1, wherein said cutting tool is a pair of scissors.

8. A method for manufacturing a joint for a cutting tool, comprising:

arranging a first blade with a hole in a mould, casting a first inlay to have a protruding end protruding into the hole in the first blade and a flange contacting an outer surface of the first blade, arranging a second blade with a hole in a mould, casting a second inlay to have a protruding end protruding into the hole in the second blade and a flange contacting an outer surface of the second blade, joining a first end of a shaft having a transverse shoulder in a second end to the protruding end of the first inlay by a screw extending through the first inlay, rotating the shaft and the second inlay into a mutual predetermined release position and threading the shaft with the shoulder into a hole in the second inlay, and rotating the shaft and the second inlay away from the mutual predetermined release position in order to engage the shoulder with an engagement surface of the second inlay and to attach the first and second blade pivotably to each other with the shoulder and the engagement surface.

* * * * *